US007225856B2

(12) United States Patent
Scott et al.

(10) Patent No.: US 7,225,856 B2
(45) Date of Patent: Jun. 5, 2007

(54) PRECIPITATION-HARDENABLE ALLOY CORE ROD, PLUNGER TIP HAVING A UNIFORM SIDE WALL THICKNESS, AND METHOD OF FORMING SAME

(75) Inventors: Gerald Scott, Gilead, OH (US); Gerald Selan, Livonia, MI (US); Terry Hildreth, Marion, OH (US)

(73) Assignee: Hildreth Manufacturing, LLC, Marion, OH (US)

( * ) Notice: Subject to any disclaimer, the term of this patent is extended or adjusted under 35 U.S.C. 154(b) by 197 days.

(21) Appl. No.: 10/633,919

(22) Filed: Aug. 4, 2003

(65) Prior Publication Data

US 2004/0026060 A1 Feb. 12, 2004

Related U.S. Application Data

(60) Provisional application No. 60/400,910, filed on Aug. 2, 2002.

(51) Int. Cl.

| | |
|---|---|
| ***B22C 1/00*** | (2006.01) |
| ***B22C 9/04*** | (2006.01) |
| ***B22C 9/05*** | (2006.01) |
| ***B22C 9/10*** | (2006.01) |

(52) U.S. Cl. ..... 164/138; 164/6; 164/131; 164/132

(58) Field of Classification Search ..... None
See application file for complete search history.

(56) References Cited

U.S. PATENT DOCUMENTS 3,823,002 A * 7/1974 Kirby, Jr. et al. ..... 428/567
6,454,880 B1 * 9/2002 Rickman, Jr. ..... 148/319
2003/0165396 A1 * 9/2003 Fehlemann et al. ..... 420/485

OTHER PUBLICATIONS

Special Metals; "NIMONIC® alloy 90"; http://www.specialmetals.com/products/data_90.htm; Jun. 11, 2002.

(Continued)

*Primary Examiner*—John P. Sheehan
(74) *Attorney, Agent, or Firm*—Martin & Ferraro, LLP

(57) ABSTRACT

A core rod is utilized in the process of forming a core in a metal casting. The core rod has a length and opposite ends The core rod is generally round in cross-section along at least a portion of the length of the core rod proximate at least one of the ends configured for use in forming the core of the metal casting. The core rod is made from a precipitation-hardenable alloy including about 40.0 to 75.0 wt. % Ni, about 0.0 to 25.0 wt. % Co, about 10.0 to 25.0 wt. % Cr, and about 0.0 to 20.0 wt. % Fe. A method for forming a core within a metal casting includes the steps of providing a precipitation-hardenable alloy core rod having a length and opposite ends; packing sand around at least one end of the core rod to form a sand core with core rod; placing the sand core with core rod into a mold; pouring molten metal into the mold and around the sand core with core rod; and producing a metal casting having a core and a uniform sidewall thickness in a range of +/−0.060 inches. An improved casting produced by the disclosed method and core rod is also disclosed.

14 Claims, 4 Drawing Sheets

OTHER PUBLICATIONS

Special Metals; "INCONEL® alloy 600"; http://www.specialmetals.com/products/data_600.htm; Jun. 11, 2002.
Special Metals; "INCONEL® alloy 718"; http://www.specialmetals.com/products/data_718.htm; Jun. 11, 2002.
Special Metals; "INCOLOY® alloy 925"; http://www.specialmetals.com/products/data_925.htm; Jun. 11, 2002.
Special Metals; "INCONEL® alloy HX"; http://www.specialmetals.com/products/data_hx.htm; Jun. 11, 2002.
Special Metals; "Waspaloy"; http://www.specialmetals.com/products/data_waspaloy; Jun. 11, 2002.
Haynes; "HASTELLOY® X alloy"; http://www.haynesintl.com/mini.Xs/X.htm ; Jun. 11, 2002.

* cited by examiner

PRECIPITATION-HARDENABLE ALLOY CORE ROD, PLUNGER TIP HAVING A UNIFORM SIDE WALL THICKNESS, AND METHOD OF FORMING SAME

The present application claims benefit of provisional application No. 60/400,910, filed Aug. 2, 2002, which is incorporated herein by reference.

BACKGROUND OF THE INVENTION

1. Field of the Invention

The present invention is directed to a precipitation-hardenable alloy core rod utilized in castings to keep the cores straight and concentric with the outer surfaces of the castings, the improved casting formed with the precipitation-hardenable alloy core rod, and the associated manufacturing method.

2. Description of the Prior Art

Typically, foundries that are manufacturing castings with internal cavities place cores into the molds to create this cavity. Cores and core rods (metal reinforcement rod) have been used by foundries for hundreds of years. However, they use inexpensive materials such as cold rolled steel or other cold worked materials as core rods in their cores. The problem is that when these cold worked materials are subjected to the high temperatures of molten metal which surrounds the core, the material stress relaxes and twists, bows, or bends. This causes the core to also bow or bend which causes the core, or hollow cavity inside a casting, to not be concentric with the outside surface of the casting. This condition is known in the foundry industry as a core shift.

One type of casting that can have core shift problems is a beryllium-copper plunger tip manufactured for the die cast industry. Beryllium-copper has a melting temperature of approximately 2300 degrees Fahrenheit. A plunger tip is used to inject or push molten metal such as molten aluminum or molten magnesium into a die or mold. This process is done under intense pressures approaching 30,000 pounds per square inch. While all of this is taking place, water is flowing through the inside of the core of the plunger tip as a method of cooling the tip.

The cooling of the plunger tip, and the concentricity of the cooling chamber core is critical, because the plunger tip is designed to push the molten aluminum or magnesium through a shot sleeve, which is a steel tube. The tip is run at a very tight clearance relative to the sleeve to prevent the molten metal from getting wedged between the plunger tip and shot sleeve, which would lead to premature failure. If the concentricity is off, the plunger tip can have portions which congregate heat in the heavy sections which can lead to a thermal breakdown, heat cracking, of the beryllium copper used in form the casting. Another problem with heavy cross sections is thermal expansion of the plunger tip, which can cause the plunger tip to swell and seize in the shot sleeve.

Yet another reason for the concentricity of the plunger tip's cooling chamber (casting cavity) being very critical, is that the die cast plants (end user) that purchases the plunger tip cut the plunger tip down to smaller diameters and re-use it. After a plunger tip fails due to wear from being used in an injection machine, the die casters machine the tip down to a smaller diameter and places it back into a smaller machine. This can happen several times. The danger is that if the concentricity is off, the plunger tip can have a thin sidewall or thin front face, which could collapse from the high pressures. If this were to happen, the internal cooling water could come into contact with the molten aluminum or molten magnesium that could result in an explosion and possible injury of the machine operator.

The thought process thus far in the die cast industry for a solution to the core shift problem in castings has been to increase and use the largest diameter cold worked steel core rod as possible. The belief was that the increased diameter of the steel core rod equated to greater strength that would in turn solve the core shift problem. This approach to solving the problem failed to recognize the actual problem causing the core shift in the castings. Core shift in the castings is not caused by actual physical bending of the core rod, but by the stress relaxing of the mechanical stress that is built up in the metal of the cold worked steel core rods during their manufacturing process. The stress relaxing of the cold worked steel core rods is a more significant issue for castings that are poured at higher temperatures, such as the approximately 2300 degrees Fahrenheit at which beryllium-copper melts, for castings that are machined over time to progressively smaller dimensions with progressive thinner walls between the casting exterior of the internal cooling chamber core, such as with plunger tips, and for castings being used in a manufacturing process, such a molten metal injection molding machines, were a casting failure can have significant consequences to the manufactures, injection molding machine, and machine operator.

Additionally, there are limitations as to the diameter of the core rods (reinforcing rods) that can be used in the manufacture of a particular casting due to the physical size limitations of the parts being cast by the foundry. For example, if a foundry is trying to cast a casting with a 0.5 inch diameter hole leading to a core, it is physically impossible to place a 0.75 inch steel rod inside the core for strength.

What is needed is a core rod and associated manufacturing method that will reliably produce castings that do not have the core shift problems previously experienced in various foundry castings. In particular, a plunger tip with improved concentricity of the core within the casting is needed to allow the end user to maximize the life of the plunger tip through additional uses by machining the plunger tip to smaller diameters. Plunger tips with a more reliably uniform sidewall thickness and face thickness are needed to increase safety by minimizing the chance of the plunger tips collapsing under the high pressures of the die casting or injection molding machines.

SUMMARY OF THE INVENTION

A preferred embodiment of the present invention includes a core rod formed of precipitation-hardenable nickel/cobalt/chromium alloy consisting of 40.0 to 75.0 wt. % nickel, 25.0 wt. % maximum cobalt, 10.0 to 25.0 wt. % chrome, 20.0 wt. % maximum iron, with any remaining elements at a 5.0 wt. % maximum per element. Core rods of this alloy have proven to be very stable at high temperatures. This combination of elements when used to form core rods has allowed the manufacture of castings with excellent concentricity in situations that previously were unattainable. Therefore in applications where concentricity of the internal cavity of the casting to the outside surfaces of the castings is critical, there are huge advantages to using a high temperature stable, precipitation-hardenable alloy for core rods.

One embodiment of the present invention utilized in the process of forming a core in a metal casting is a core rod having a length and opposite ends. The core rod is preferably generally round in cross-section along at least a portion of the length of the core rod proximate at least one of the ends configured for use in forming the core of the metal casting. A preferred core rod is made from a precipitation-hardenable alloy including about 40.0 to 75.0 wt. % Ni, about 10.0 to 25.0 wt. % Cr, about 0.0 to 25.0 wt. % Co, and about 0.0 to 20.0 wt. % Fe. The alloy may include incidental impurities.

In particular, a preferred core rod alloy includes about 50.0 to 55.0 wt. % Ni, up to 10.0 wt. % Co, and about 17.0 to 21.0 wt. % Cr. Another embodiment of a preferred core rod alloy includes about 42.0 to 46.0 wt. % Ni, and about 19.0 to 23.0 wt. % Cr. Yet another embodiment of a preferred core rod alloy includes at least 72.0 wt. % Ni, about 14.0 to 17.0 wt. % Cr, and about 6.0 to 10.0 wt. % Fe.

A preferred embodiment of the present invention for forming a core within a metal casting includes the steps of providing a precipitation-hardenable alloy core rod having a length and opposite ends; packing sand around at least one end of the core rod to form a sand core with core rod; placing the sand core with core rod into a mold; pouring molten metal into the mold and around the sand core with core rod; and producing a metal casting having a core and a uniform sidewall thickness in a range of +/−0.060 inches. The providing step may includes the step of providing a core rod being made from a precipitation-hardenable alloy including about 40.0 to 75.0 wt. % Ni, about 0.0 to 25.0 wt. % Co, about 10.0 to 25.0 wt. % Cr, and about 0.0 to 20.0 wt. % Fe. The providing step includes the steps of providing a rod core that does not stress relax during and after the pouring step, that remains straight during and after the pouring step, and that does not bend during and after the pouring step. A preferred method of the present invention further includes the step of solidifying the metal in the mold and around the sand core with core rod to form the casting. The producing step preferably includes the step of machining the casting into a plunger tip for use in one of aluminum and magnesium die casting operations. The pouring step preferably includes the step of pouring a beryllium-copper alloy.

In one preferred embodiment of the present invention, a beryllium-copper alloy plunger tip for use in aluminum and magnesium die casting operations is formed utilizing the disclosed method. The plunger tip preferably includes a cylindrical body closed at one end and has an axially extending cavity therein. The body has a generally uniform sidewall thickness, which is preferably uniform within +/−0.060 inches. A preferred body is internally threaded to enable the plunger tip to be connected to a rod.

These and other objects and advantages of the present invention will be apparent from review of the following specification and the accompanying drawings.

DETAILED DESCRIPTION OF THE PREFERRED EMBODIMENT

Figure 1:
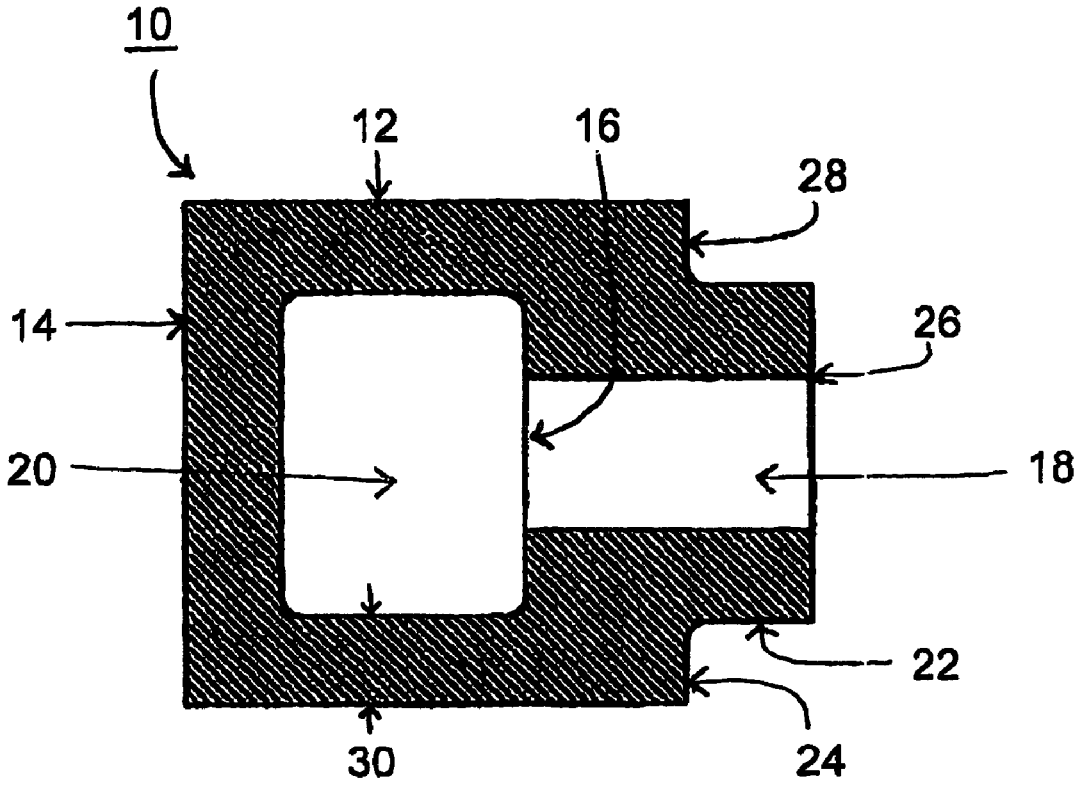
FIG. 1 is an axial cross-section view of a plunger tip casting of one embodiment of the present invention.

FIG. 1 illustrates in axial cross-section a metal plunger tip 10 as manufactured and shipped to the aluminum or magnesium die casting customer. Plunger tip 10 includes a cylindrical body 12 having a closed or front end 14 and a cylindrical cavity or core 16 extending coaxially with the diameter of the body 12. The core 16 has a neck 18 and an enlarged cooling or water chamber 20. A shank 22 of smaller diameter than the body 12 extends axially from the opposite end 24 of the body 12. Shank 22 is adapted to be connected to one end of a control rod (not shown) by a threaded bore 26 in shank 22. The exterior of shank 16 may be hex-shaped to facilitate using a wrench to attach plunger tip 10 to the control rod of a die casting or injection molding machine. The junction between body 12 and shank 22 is a shoulder 28. A sidewall 30 preferably has a generally uniform thickness of +/−0.060 inches both before and after machining the exterior to finish plunger tip 10.

Figure 2:
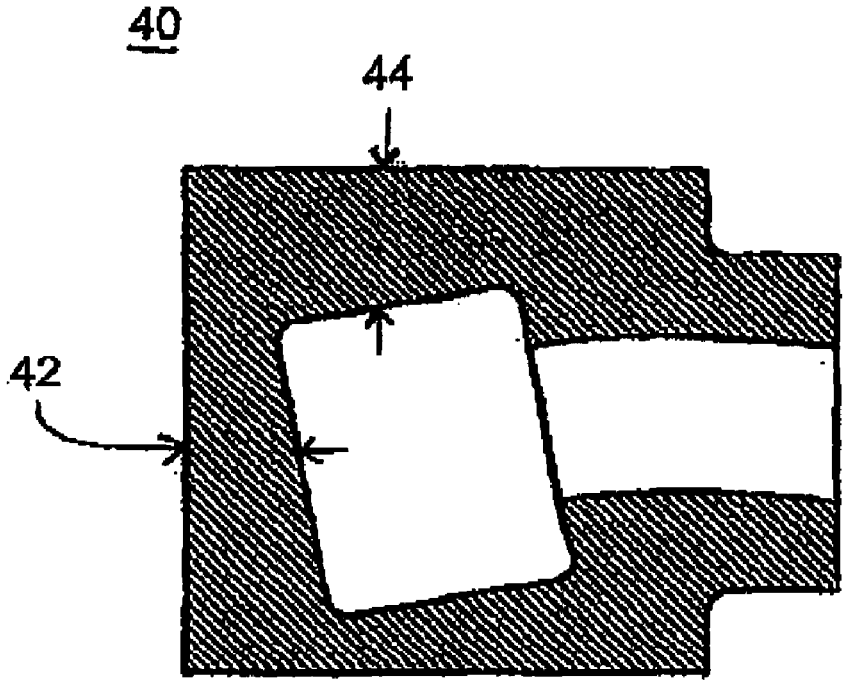
FIG. 2 PRIOR ART
FIG. 2 is an axial cross-section view of a plunger tip casting having a core shift therein.

FIG. 2 illustrates in axial cross-section a metal plunger tip 40 having a front face 42 having an irregular thickness and a sidewall 44 having an irregular thickness due to a core shift problem. Plunger tip 40 was made using a cold roll/hot roll steel core rod in a sand core.

Figure 3:
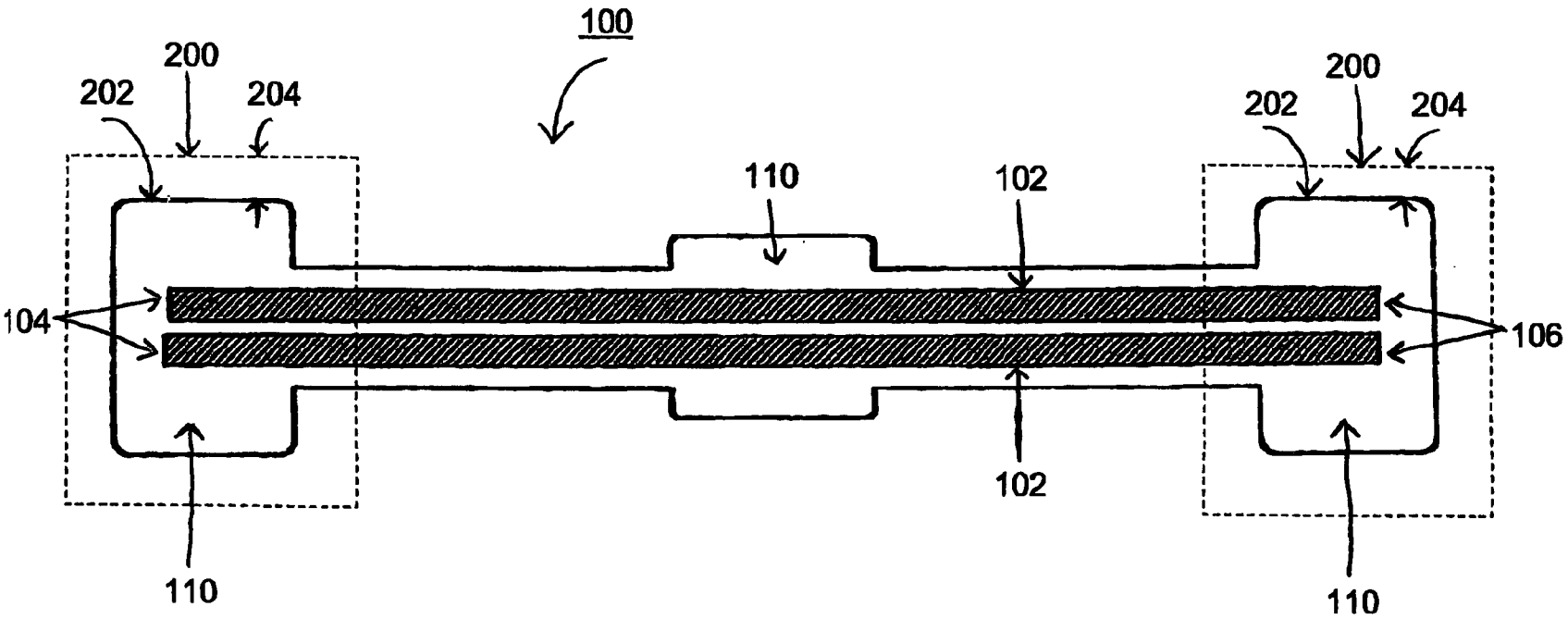
FIG. 3 is an axial cross-section view of a sand core with core rods designed for a two casting method in accordance with one embodiment of the present invention.

FIG. 3 is an axial cross-section view of a sand core with core rods designed for a two casting method in accordance with one embodiment of the present invention with a casting shown in dashed lines. A preferred embodiment of the present invention includes core 100 including two core rods 102 formed of precipitation-hardenable nickel/cobalt/chromium alloy consisting of 40.0 to 75.0 wt. % nickel, 25.0 wt. % maximum cobalt, 10.0 to 25.0 wt. % chrome, 20.0 wt. % maximum iron, with any remaining elements at a 5.0 wt. % maximum per element. Core rod 102 is utilized in the process of forming a core or water chamber in a metal casting 200 (shown in dashed lines). Core rod 102 has a length with opposite ends 104, 106. Core rod 102 is preferably generally round in cross-section along at least a portion of length of core rod 102 proximate at least one of ends 104, 106 configured for use in forming the core of metal casting 200.

A particularly preferred core rod alloy includes about 50.0 to 55.0 wt. % Ni, up to 10.0 wt. % Co, and about 17.0 to 21.0 wt. % Cr and is sold under the trade name INCONEL® alloy 718 by Special Metals. INCONEL® alloy 718 is expensive at around $12.00 per pound while cold rolled steel is approximately $0.10 per pound. INCONEL® alloy 718 and similar alloys having the preferred characteristics described herein often cost over one hundred times more than cold rolled steel per pound. The Applicants have determined that the improved quality and safety associated with using the castings made with the core rods of the present invention, however, make this expense worth the additional cost.

Another embodiment of a preferred core rod alloy includes about 42.0 to 46.0 wt. % Ni, and about 19.0 to 23.0 wt. % Cr and is sold under the trade name INCONEL® alloy 925 by Special Metals. Yet another embodiment of a preferred core rod alloy includes at least 72.0 wt. % Ni, about 14.0 to 17.0 wt. % Cr, and about 6.0 to 10.0 wt. % Fe and is sold under the trade name INCONEL® alloy 600 by Special Metals.

As best illustrated in FIG. 3, a preferred embodiment of the present invention for forming a sand core with core rod or core 100 within metal casting 200 includes the steps of providing a precipitation-hardenable alloy core rod 102 having length with opposite ends 104,106; packing sand 110 around at least one end, but preferably both ends, 104, 106 of core rod 102 to form a sand core with core rod 100; placing sand core with core rod 100 into a mold; pouring molten metal into the mold and around sand core with core rod 100; and producing a metal casting 200 having a core 202 and a uniform sidewall thickness 204 in a range of +/−0.060 inches. The providing step preferably includes the steps of providing a rod core 102 that does not stress relax during and after the pouring step, that remains straight during and after the pouring step, and that does not bend during and after the pouring step. A preferred method of the present invention further includes the step of solidifying the metal in the mold and around sand core with core rod 100 to form casting 200. The producing step preferably includes the step of machining casting 200 into a plunger tip 10 for use in one of aluminum and magnesium die casting operations. The pouring step preferably includes the step of pouring a beryllium-copper alloy.

Figure 4:
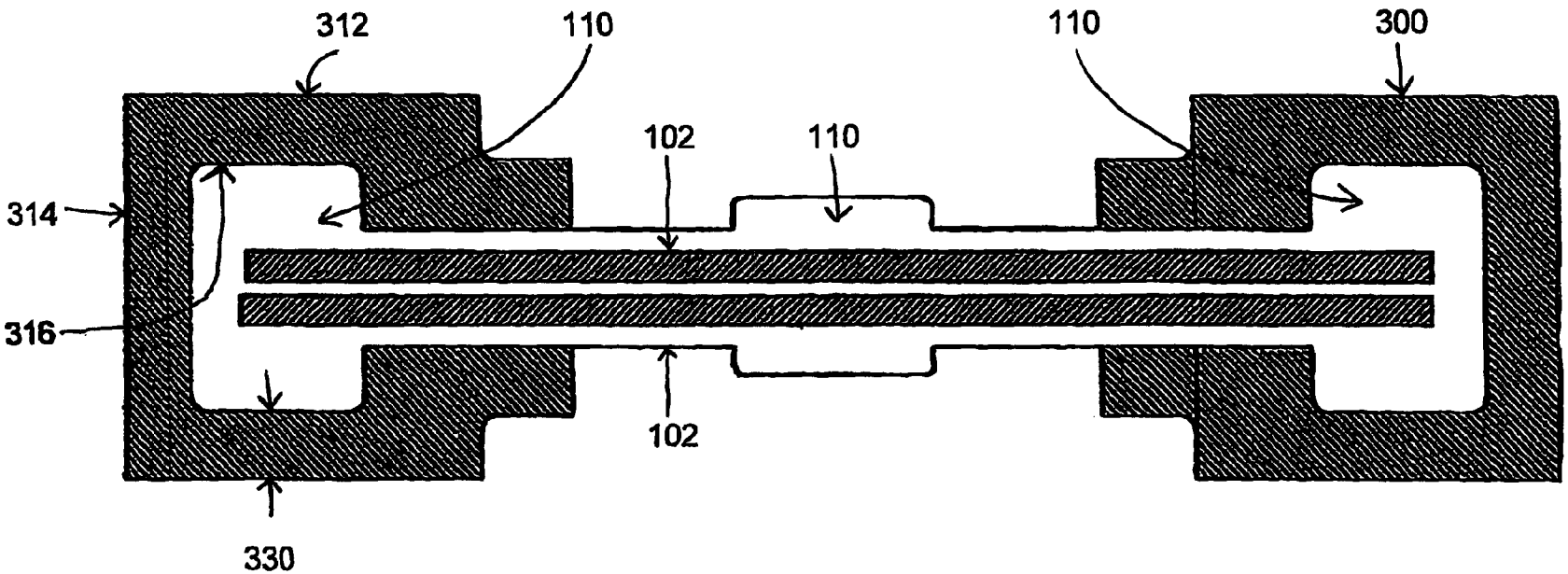
FIG. 4 is an axial cross-section view of two castings on a sand core with core rods in accordance with one embodiment of the present invention.

FIG. 4 is an axial cross-section view of two castings on sand core with core rod 100 in accordance with one embodiment of the present invention. In one preferred embodiment of the present invention, a beryllium-copper alloy plunger tip 300 for use in aluminum and magnesium die casting operations is formed utilizing the disclosed method. Plunger tip 300 preferably includes cylindrical body 312 closed at front end 314 and having an axially extending cavity or core 316 therein. Body 312 has a generally uniform sidewall 330 thickness, which is preferably uniform within +/−0.060 inches. A preferred body 312 has internally threaded bore to enable plunger tip 300 to be connected to a rod (not shown). Alternatively, an adapter (not shown) having a first end and an opposite second end may be used between plunger tip 300 and the rod. In this alternative, body 312 is internally threaded to cooperatively engage at the first end of the adaptor. The second end of the adapter is adapted to cooperatively engage the rod.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A method of forming a core within a metal casting, the method comprising the steps of:

providing a precipitation-hardenable alloy core rod having a length and opposite ends;

packing sand around at least one end of the core rod to form a sand core with core rod;

placing the sand core with core rod into a mold;

pouring molten metal into the mold and around the sand core with core rod; and producing a metal casting having a core and a uniform sidewall thickness having a deviation in the thickness in a range of +/−0.060 inches.

2. The method of claim 1, wherein the providing step includes the step of providing a core rod being made from a precipitation-hardenable alloy comprising about 40.0 to 75.0 wt. % Ni, about 0.0 to 25.0 wt. % Co, about 10.0 to 25.0 wt. % Cr, and about 0.0 to 20.0 wt. % Fe.

3. The method of claim 2, wherein the providing step includes the step of providing a rod core that does not stress relax during and after the pouring step.

4. The method of claim. 2, wherein the providing step includes the step of providing a rod core that remains straight during and after the pouring step.

5. The method of claim 2, wherein the providing step includes the step of providing a rod core that does not bend during and after the pouring step.

6. The method of claim 2, further comprising the step of solidifying the metal in the mold and around the sand core with core rod to form the casting.

7. The method of claim 6, wherein the providing step includes the step of providing a rod core that does not stress relax during the solidifying step.

8. The method of claim 6, wherein the providing step includes the step of providing a rod core that remains straight during the solidifying step.

9. The method of claim 6, wherein the providing step includes the step of providing a rod core that does not bend during the solidifying step.

10. The method of claim 2, wherein the producing step includes the step of machining the casting into a plunger tip for use in one of aluminum and magnesium die casting operations.

11. The method of claim 10, wherein the pouring step includes the step of.

12. The method of claim 11, wherein the machining step includes the step of machining the casting into a plunger tip having a cylindrical.

13. The method of claim 12, further comprising the step of internally threading the body of the plunger tip to enable the plunger tip to be connected to a rod.

14. The method of claim 1, wherein the providing step includes the step of providing a core rod being made from a Ni based precipitation-hardenable alloy.

* * * * *

UNITED STATES PATENT AND TRADEMARK OFFICE

CERTIFICATE OF CORRECTION

PATENT NO. : 7,225,856 B2
APPLICATION NO. : 10/633919
DATED : June 5, 2007
INVENTOR(S) : Gerald Scott et al.

It is certified that error appears in the above-identified patent and that said Letters Patent is hereby corrected as shown below:

Column 6:
Line 15: change "claim. 2," to -- claim 2, --;
Line 38: change "step of." to -- step of pouring a beryllium-copper alloy. --;
Lines 39-41: delete in their entirety; and
Line 42: change "claim 12" to -- claim 10 --.

Signed and Sealed this

Seventh Day of August, 2007

JON W. DUDAS
*Director of the United States Patent and Trademark Office*